US008380091B2

(12) United States Patent
Brown et al.

(10) Patent No.: US 8,380,091 B2
(45) Date of Patent: Feb. 19, 2013

(54) RESONANT-FREQUENCY MEASUREMENT OF ELECTROPHOTOGRAPHIC DEVELOPER DENSITY

(75) Inventors: Kenneth J. Brown, Penfield, NY (US); Charles H. Hasenauer, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 167 days.

(21) Appl. No.: 12/847,192

(22) Filed: Jul. 30, 2010

(65) Prior Publication Data

US 2012/0027433 A1 Feb. 2, 2012

(51) Int. Cl.
*G03G 15/08* (2006.01)

(52) U.S. Cl. ..... 399/27

(58) Field of Classification Search ..... 399/27, 399/30, 58, 61, 62

See application file for complete search history.

(56) References Cited

U.S. PATENT DOCUMENTS

| | | | | |
|---|---|---|---|---|
| 3,932,034 | A | 1/1976 | Takahashi | |
| 4,519,696 | A | 5/1985 | Bruyndonckx | |
| 4,987,453 | A | 1/1991 | Laukaitis | |
| 5,006,897 | A | 4/1991 | Rimai et al. | |
| 5,212,842 | A | 5/1993 | Glydon | |
| 5,655,183 | A | 8/1997 | Tobms | |
| 6,275,665 | B1 * | 8/2001 | Miyashiro | 399/27 |
| 6,294,304 | B1 | 9/2001 | Sukovichy | |
| 6,498,908 | B2 | 12/2002 | Philips | |
| 6,608,641 | B1 | 8/2003 | Alexandrovich et al. | |
| 7,120,379 | B2 | 10/2006 | Eck | |
| 2002/0154918 | A1 | 10/2002 | Sawayama | |
| 2002/0168200 | A1 | 11/2002 | Stelter et al. | |
| 2006/0133870 | A1 | 6/2006 | Ng et al. | |
| 2010/0150592 | A1 | 6/2010 | Brown | |

FOREIGN PATENT DOCUMENTS

| | | |
|---|---|---|
| JP | 63208887 | 8/1988 |
| JP | 05249788 | 9/1993 |
| JP | 07248676 | 9/1995 |

OTHER PUBLICATIONS

Machine translation of (JP 2005031245). Publication date, Feb. 3, 2005.*

Machine translation of (JP 2000305348 A). Publication date, Nov. 2, 2000.*

* cited by examiner

*Primary Examiner* — Walter L Lindsay, Jr.
*Assistant Examiner* — Frederick Wenderoth
(74) *Attorney, Agent, or Firm* — Christopher J. White

(57) ABSTRACT

Developer density is measured in an electrophotographic system. First and second electrodes are disposed to define a working volume between them through which developer passes without contacting the first electrode, wherein the electrodes are electrically insulated from each other by the working volume. One terminal of an AC voltage (current) source having a selected frequency is connected to one of the electrodes. An inductor is connected in series (parallel) with the voltage source, so that the source provides the AC bias (current) across the electrodes through (across) the inductor. The AC is applied and the current (voltage) across the electrodes is measured. The density of the developer in the working volume is automatically determined using a processor responsive to the measured current (voltage) and the applied bias (current).

15 Claims, 16 Drawing Sheets

| Plate Area in^2 | Amplitude P-P kV | Frequency kHz | Spacing in | Slope | Intercept | R^2 |
|---|---|---|---|---|---|---|
| 0.5 | 1 | 1 | 0.05 | 0.009 | 0.573 | 0.723 |
| 0.5 | 1 | 1 | 0.09 | 0.005 | 0.587 | 0.982 |
| 0.5 | 1 | 3 | 0.05 | 0.009 | 1.731 | 0.701 |
| 0.5 | 1 | 3 | 0.09 | 0.006 | 1.706 | 0.523 |
| 0.5 | 2 | 2 | 0.07 | 0.011 | 2.229 | 0.692 |
| 0.5 | 3 | 1 | 0.05 | 0.007 | 1.791 | 0.642 |
| 0.5 | 3 | 1 | 0.09 | -0.004 | 1.704 | 0.913 |
| 0.5 | 3 | 3 | 0.09 | 0.057 | 5.055 | 0.999 |
| 0.5 | 3 | 3 | 0.05 | 0.047 | 5.160 | 1.000 |
| 1 | 1 | 2 | 0.07 | 0.007 | 1.140 | 0.913 |
| 1 | 2 | 1 | 0.07 | 0.014 | 1.195 | 0.999 |
| 1 | 2 | 2 | 0.07 | 0.061 | 2.158 | 0.994 |
| 1 | 2 | 2 | 0.05 | 0.040 | 2.246 | 0.976 |
| 1 | 2 | 2 | 0.07 | 0.035 | 2.303 | 0.996 |
| 1 | 2 | 2 | 0.09 | 0.023 | 2.224 | 0.576 |
| 1 | 2 | 2 | 0.07 | 0.023 | 2.293 | 0.702 |
| 1 | 2 | 3 | 0.07 | 0.036 | 3.507 | 0.942 |
| 1 | 3 | 2 | 0.07 | 0.065 | 3.296 | 0.861 |
| 2 | 1 | 1 | 0.05 | 0.024 | 0.612 | 0.988 |
| 2 | 1 | 1 | 0.09 | 0.009 | 0.656 | 0.991 |
| 2 | 1 | 3 | 0.05 | 0.061 | 2.026 | 0.991 |
| 2 | 1 | 3 | 0.09 | 0.029 | 1.850 | 0.967 |
| 2 | 2 | 2 | 0.07 | 0.044 | 2.507 | 0.993 |
| 2 | 3 | 1 | 0.05 | 0.078 | 2.036 | 0.999 |
| 2 | 3 | 1 | 0.09 | 0.038 | 1.860 | 0.787 |
| 2 | 3 | 3 | 0.05 | 0.184 | 6.132 | 0.992 |
| 2 | 3 | 3 | 0.09 | 0.091 | 5.650 | 0.989 |

*FIG. 6C*

RESONANT-FREQUENCY MEASUREMENT OF ELECTROPHOTOGRAPHIC DEVELOPER DENSITY

CROSS-REFERENCE TO RELATED APPLICATIONS

Reference is made to commonly assigned, co-pending U.S. patent application Ser. No. 12/847,143 (Publication No. 2012/0027430, Feb. 2, 2012), filed concurrently herewith, entitled Measuring Developer Density In An Electrophotographic System by Brown, et al, U.S. patent application Ser. No. 12/847,158 (Publication No. 2012/0027431, Feb. 2, 2012), filed concurrently herewith, entitled Electrophotographic Developer Toner Concentration Measurement, by Brown, et al, and U.S. patent application Ser. No. 12/847,175 (Publication No. 2012/0027432), filed concurrently herewith, entitled Electrophotographic Developer Flow Rate Measurement, by Brown, et al, the disclosures of which are incorporated by reference herein.

FIELD OF THE INVENTION

This invention pertains to the field of electrophotographic printing and more particularly to sensing characteristics of developer during printer operation.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

Electrophotographic developer can include toner particles and magnetic carrier particles, and is transported past the photoreceptor by a development member. Developer is compressible, and the image quality of the print image is strongly correlated with developer density. However, existing methods for measuring developer density and other properties require off-line processing, so it cannot provide the data necessary to maintain image quality on-line and thereby improve throughput of a printer.

Commonly-assigned U.S. Publication No. 2002/0168200 ('200) by Steller et al., the disclosure of which is incorporated herein by reference, describes determining developer mass velocity by, among other things, measuring developer flow rate and developer mass area density (DMAD). Measuring flow rate requires collecting developer in a hopper from a bench-top toning station, and measuring DMAD requires abruptly stopping the toning station. Although these operations are useful, neither is suitable for an operating machine; both are invasive procedures that require the machine to be partially disassembled.

U.S. Pat. No. 6,498,908 to Phillips et al. describes a charge measurement device for measuring charge transfer between a high-voltage power supply and a developing device during an imaging operation. However, charge transfer can occur for various reasons, and it can be difficult to determine which reason affects a particular charge transfer. A single measurement is therefore not always enough information to fix a problem.

U.S. Pat. No. 4,519,696 to Bruyndonckx et al. describes inductive measurement of toner concentration in a developer mixer. However, toner concentration and developer flow rate both affect the percentage of carrier particles in the measurement volume of a sensor, and therefore the developer density measured by that sensor.

There is a continuing need, therefore, for a way of measuring developer density, separating out different effects from each other.

SUMMARY OF THE INVENTION

According to a first aspect of the present invention, there is provided a method of measuring developer density in an electrophotographic system, comprising:

providing a first electrode and a second electrode disposed to define a working volume between them through which developer passes without contacting the first electrode, wherein the electrodes are electrically insulated from each other by the working volume;

connecting one terminal of a voltage source for selectively providing an AC bias having a selected frequency to one of the electrodes;

providing an inductor in series with the voltage source, the inductor being connected to the other of the electrodes, whereby the source provides the AC bias across the electrodes through the inductor;

applying the bias using the voltage source;

measuring the current across the electrodes while the bias is applied; and automatically determining the density of the developer in the working volume using a processor responsive to the measured current and the applied bias. According to a second aspect of the present invention, there is provided a method of measuring developer density in an electrophotographic system, comprising:

providing a first electrode and a second electrode disposed to define a working volume between them through which developer passes without contacting the first electrode, wherein the electrodes are electrically insulated from each other by the working volume;

connecting the two terminals of a current source for selectively providing an alternating current having a selected frequency to the first and second electrodes, respectively;

providing an inductor in parallel with the current source, whereby the source provides the alternating current across the electrodes and the inductor;

applying the alternating current using the current source;

measuring the voltage across the electrodes while the bias is applied; and automatically determining the density of the developer in the working volume using a processor responsive to the measured voltage and the applied bias.

An advantage of this invention is that it provides non-contact measurements. Measurements are taken quickly, in embodiments in real time. Various quantities can be measured in-situ, with no disassembly required. The measurements use inexpensive hardware, and work with any toner/carrier combination. Various embodiments provide individual measurements of specific quantities, deconfounded from other quantities.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein:

FIG. 6C shows the conditions used in FIG. 6B;

Figure 1:
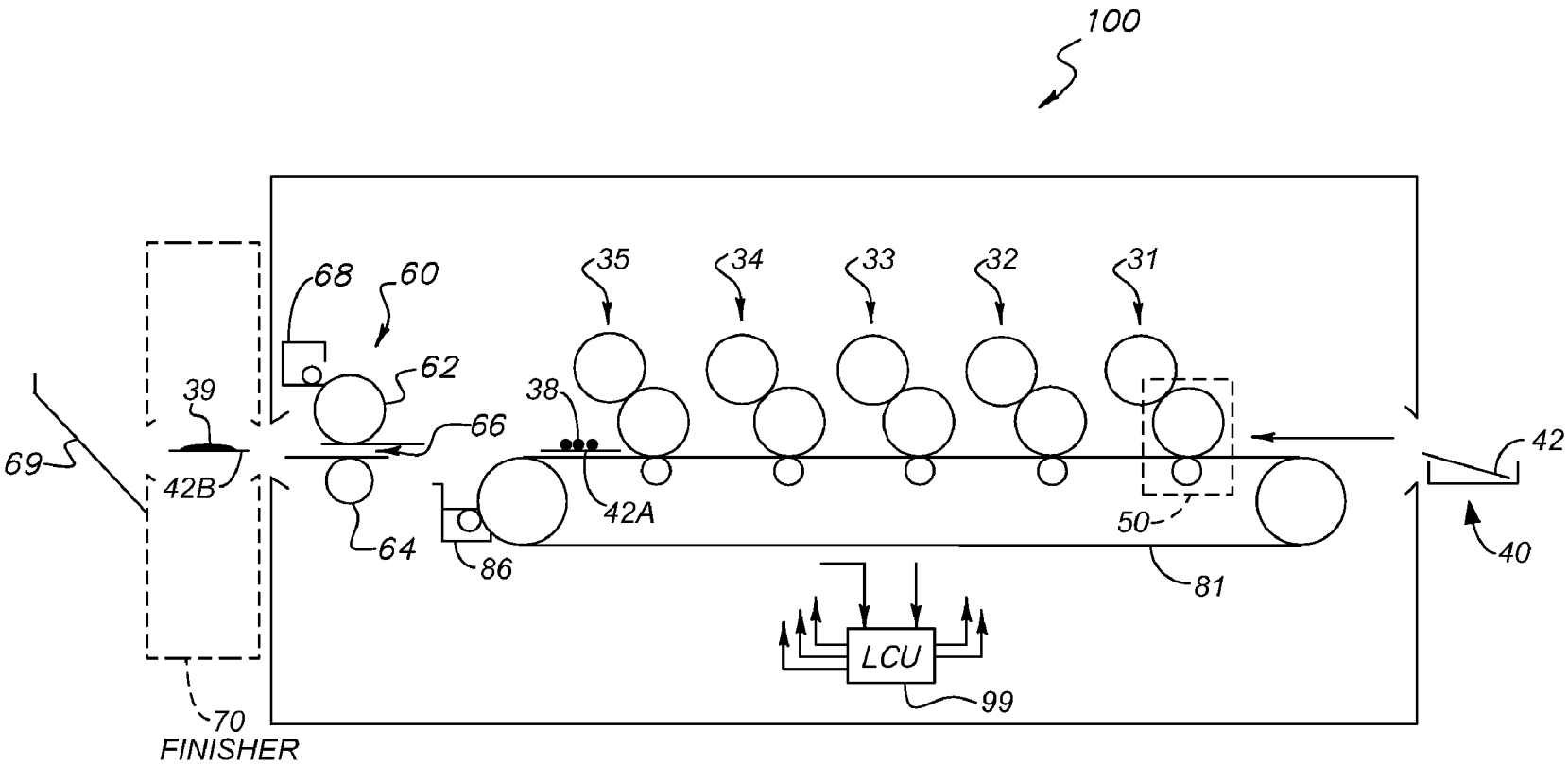
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

In a two component development system, the ability to apply sufficient developer (toner+carrier, as discussed below) to develop the latent image on the photoconductor is important in creating images with high fidelity and image quality. In various embodiments, developer has a predetermined optimum ratio of toner to carrier (Toner Concentration) and a controlled ratio of the charge on a prescribed amount of toner to its mass (Charge/Mass, or q/m ratio μc/gm). "Developer flow" refers to the amount of developer delivered to the toning zone per unit time. Developer flow can be measured by lowering a gate into the developer stream (e.g., a gate 2" wide) and collecting developer for a specified amount of time (e.g., 0.5 sec). The collected developer is then weighed and reported in units of gm/in/s. Developer flow is correlated to imaging properties of the developer, such as toning contrast, and background. Since the measurement of developer flow aggregates the effects of developer mass density (nap density ND, gm/in$^3$) and developer velocity (nap velocity NV, in/s), the flow measurement is also proportional to the product of independently-measured developer mass density and developer velocity.

As discussed above, this flow-measurement method, although useful, needs to be made with the developer station removed from the machine, requires a scale, and thus is not well suited for a real time application. However, it is desirable to measure flow in real time. Flat-field uniformity can be improved by increasing the product ND*NV of the developer mass density (ND) (gm/in$^3$) and the developer velocity (NV) (in/s). However, ND cannot be increased arbitrarily. There is a limit on maximum developer density since over-compression of the developer can lead to catastrophic release of the developer from the toning station, e.g., in fully-compressed sheets. This phenomenon is known as Developer Compression Limit Failure (DCL), or "plop-out." Measuring ND and NV separately can reveal different aspects of the developer that can be varied (e.g., velocity) to improve developer ND*NV, and thus image quality, without the negative side effects of developer over-compression.

Developer Mass Area Density (DMAD) is another measure of developer density, and is generally measured in terms of gm/in^2. DMAD is measured by collecting the developer in a unit area. Ratio q/m is the toner charge to mass ratio and is generally expressed in μC/gm. TC is toner concentration and is given in terms of weight percent of toner to developer. In an embodiment, TC is approximately 6 wt. pct.

As discussed above, image quality is related to developer density. This is discussed further in commonly-assigned co-pending application U.S. Ser. No. 12/333,355, filed Dec. 12, 2008 (Publication No. 2010/0150592), by Kenneth J. Brown, the disclosure of which is incorporated herein by reference.

As used herein, the terms "parallel" and "perpendicular" have a tolerance of ±10°.

As used herein, "sheet" is a discrete piece of media, such as receiver media for an electrophotographic printer (described below). Sheets have a length and a width. Sheets are folded along fold axes, e.g. positioned in the center of the sheet in the length dimension, and extending the full width of the sheet. The folded sheet contains two "leaves," each leaf being that portion of the sheet on one side of the fold axis. The two sides of each leaf are referred to as "pages." "Face" refers to one side of the sheet, whether before or after folding.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture including toner particles and magnetic carrier particles, which can be electrically-conductive (useful in conventional two-component development systems) or non-conductive (useful in small-particle, dry (SPD) development systems). Toner particles can be magnetic or non-magnetic. The carrier particles can be larger than the toner particles, e.g. 15-20 μm or 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
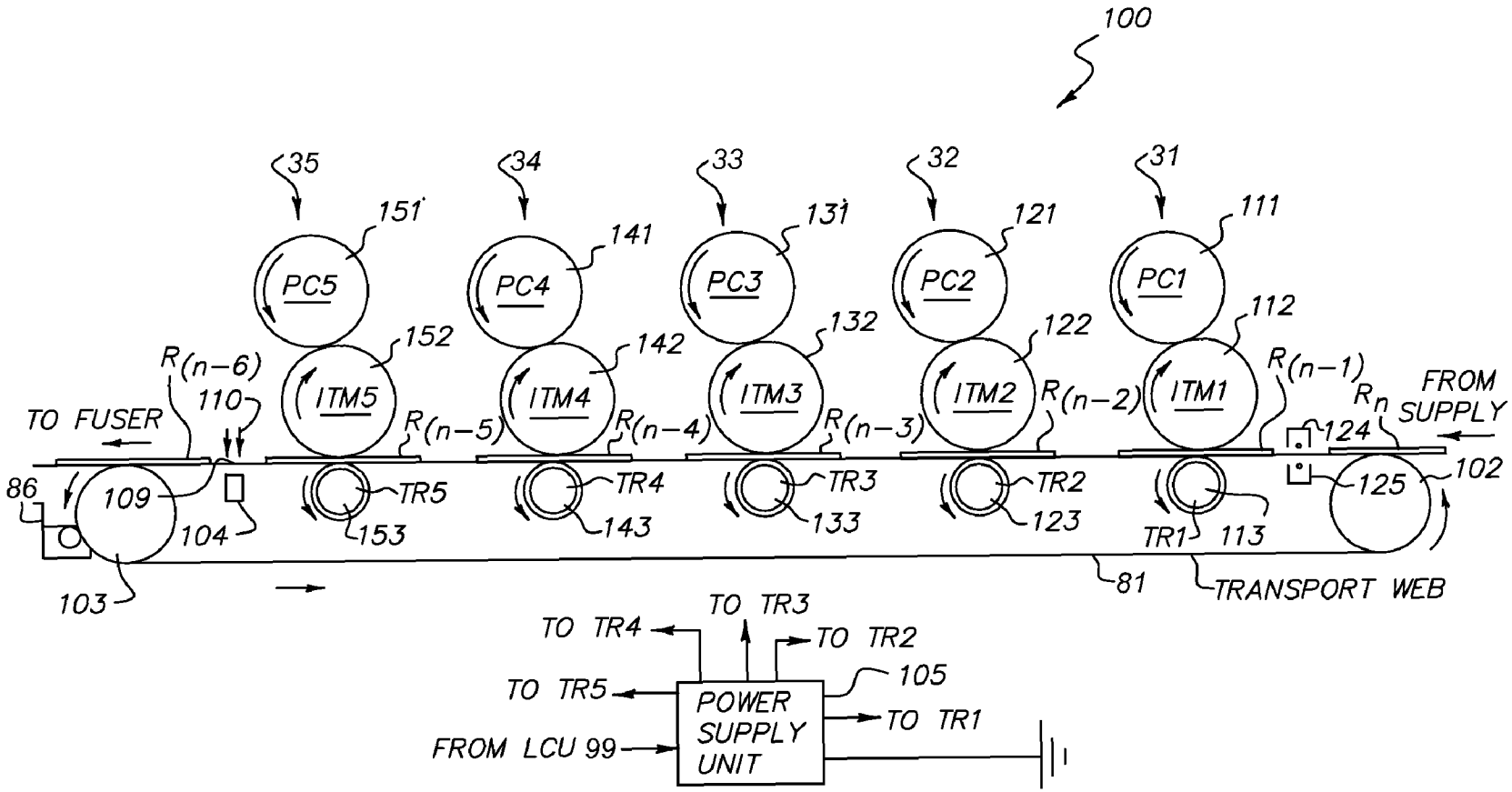
FIG. 2 is an elevational cross-section of the reprographic image-producing portion of the apparatus of FIG. 1.
Figure 3:
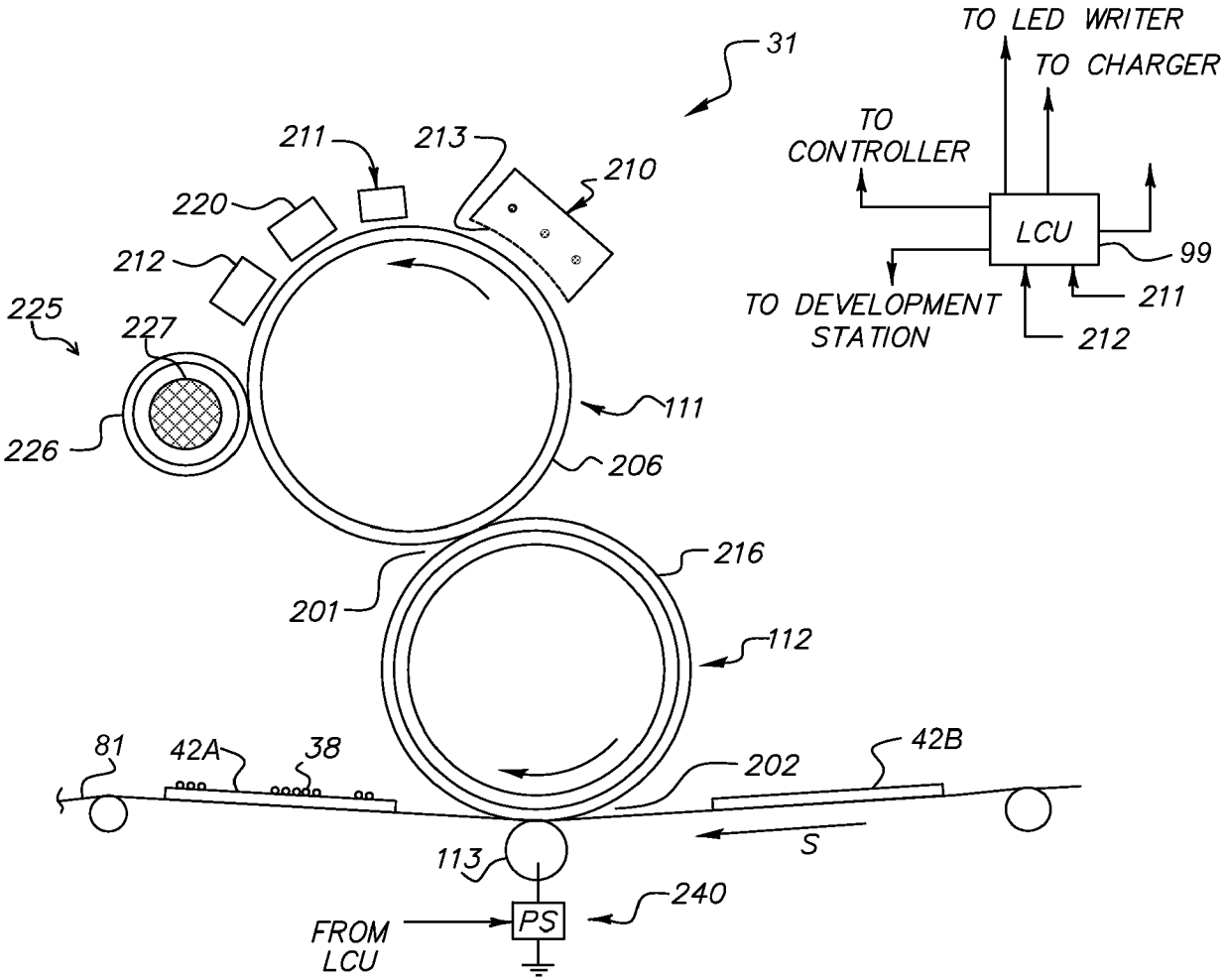
FIG. 3 is an elevational cross-section of one printing module of the apparatus of FIG. 1.

FIGS. 1-3 are elevational cross-sections showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g. fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of the respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Referring to FIG. 2, receivers $R_n$–$R_{(n-6)}$ are delivered from supply unit 40 (FIG. 1) and transported through the printing modules 31, 32, 33, 34, 35. The receivers are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging member (111, 121, 131, 141, 151), e.g. a roller or belt, an intermediate transfer member (112, 122, 132, 142, 152), e.g. a blanket roller, and transfer backup member (113, 123, 133, 143, 153), e.g. a roller, belt or rod. Thus in printing module 31, a print image (e.g. a black separation image) is created on imaging member PC1 (111), transferred to intermediate transfer member ITM1 (112), and transferred again to receiver $R_{(n-1)}$ moving through transfer subsystem 50 (FIG. 1) that includes transfer member ITM1 (112) forming a pressure nip with a transfer backup member TR1 (113). Similarly, printing modules 32, 33, 34, and 35 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). The direction of transport of the receivers is the slow-scan direction; the perpendicular direction, parallel to the axes of the intermediate transfer members (112, 122, 132, 142, 152), is the fast-scan direction.

A receiver, $R_n$, arriving from supply unit 40 (FIG. 1), is shown passing over roller 102 for subsequent entry into the transfer subsystem 50 (FIG. 1) of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35. An unfused print image formed on receiver $R_{(n-6)}$ is moving as shown towards fuser 60 (FIG. 1).

A power supply 105 provides individual transfer currents to the transfer backup members 113, 123, 133, 143, and 153. LCU 99 (FIG. 1) provides timing and control signals to the components of printer 100 in response to signals from sensors in printer 100 to control the components and process control parameters of the printer 100. A cleaning station 86 for transport web 81 permits continued reuse of transport web 81. A densitometer array includes a transmission densitometer 104 using a light beam 110. The densitometer array measures optical densities of five toner control patches transferred to an interframe area 109 located on transport web 81, such that one or more signals are transmitted from the densitometer array to a computer or other controller (not shown) with corresponding signals sent from the computer to power supply 105. Densitometer 104 is preferably located between printing module 35 and roller 103. Reflection densitometers, and more or fewer test patches, can also be used.

FIG. 3 shows more details of printing module 31, which is representative of printing modules 32, 33, 34, and 35 (FIG. 1). Primary charging subsystem 210 uniformly electrostatically charges photoreceptor 206 of imaging member 111, shown in the form of an imaging cylinder. Charging subsystem 210 includes a grid 213 having a selected voltage. Additional necessary components provided for control can be assembled about the various process elements of the respective printing modules. Measuring device 211 measures the uniform electrostatic charge provided by charging subsystem 210, and measuring device 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g. laser or LED writers), and the respective development station 225 of each printing module 31, 32, 33, 34, 35 (FIG. 1), among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g. of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 (FIG. 1) which the light source (e.g. laser or LED) can expose with a selected exposure different from the exposure of another engine pixel. Engine pixels can overlap, e.g. to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, for applying toner of a selected color to the latent image on photoreceptor 206 to produce a visible image on photoreceptor 206. Development station 225 is electrically biased by a suitable respective voltage to develop the respective latent image, which voltage can be supplied by a power supply (not shown). Developer is provided to toning shell 226 by a supply system (not shown), e.g. a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Publication No. 2002/0168200 to Steller et al., published Nov. 14, 2002, the disclosures of which are incorporated herein by reference. Development station 225 can also employ a mono-component developer comprising toner, either magnetic or non-magnetic, without separate magnetic carrier particles.

Transfer subsystem 50 (FIG. 1) includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g. 42B) which receives the respective toned print images 38 from each printing module in superposition to form a composite image thereon. Print image 38 is e.g. a separation of one color, such as cyan. Receivers are transported by transport web 81. Transfer to a receiver is effected by an electrical field provided to transfer backup member 113 by power source 240, which is controlled by LCU 99. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Figure 4:
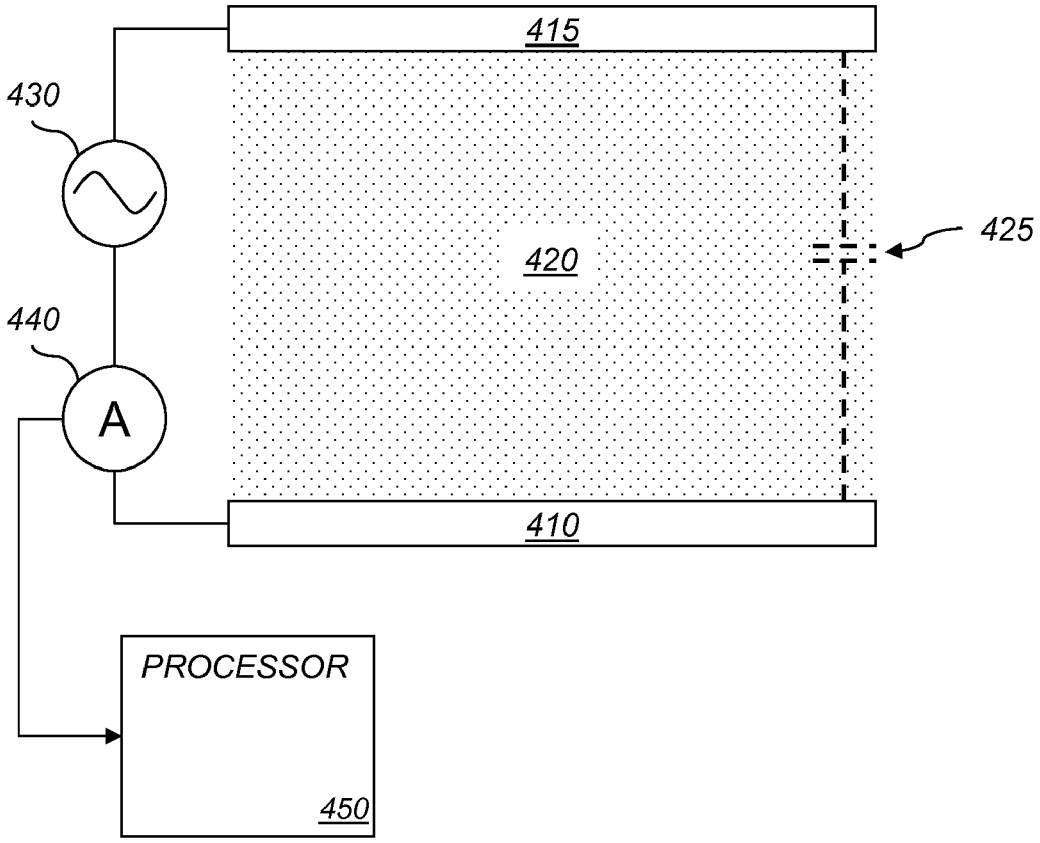
FIG. 4 shows an apparatus for measuring developer density in an electrophotographic system according to an embodiment of the present invention.

FIG. 4 shows apparatus for measuring developer density in an electrophotographic system according to an embodiment of the present invention. In some monocomponent systems, developer density and toner density are equal. In some dual-component systems, developer density is the net density of toner particles and carrier particles.

Figure 7:
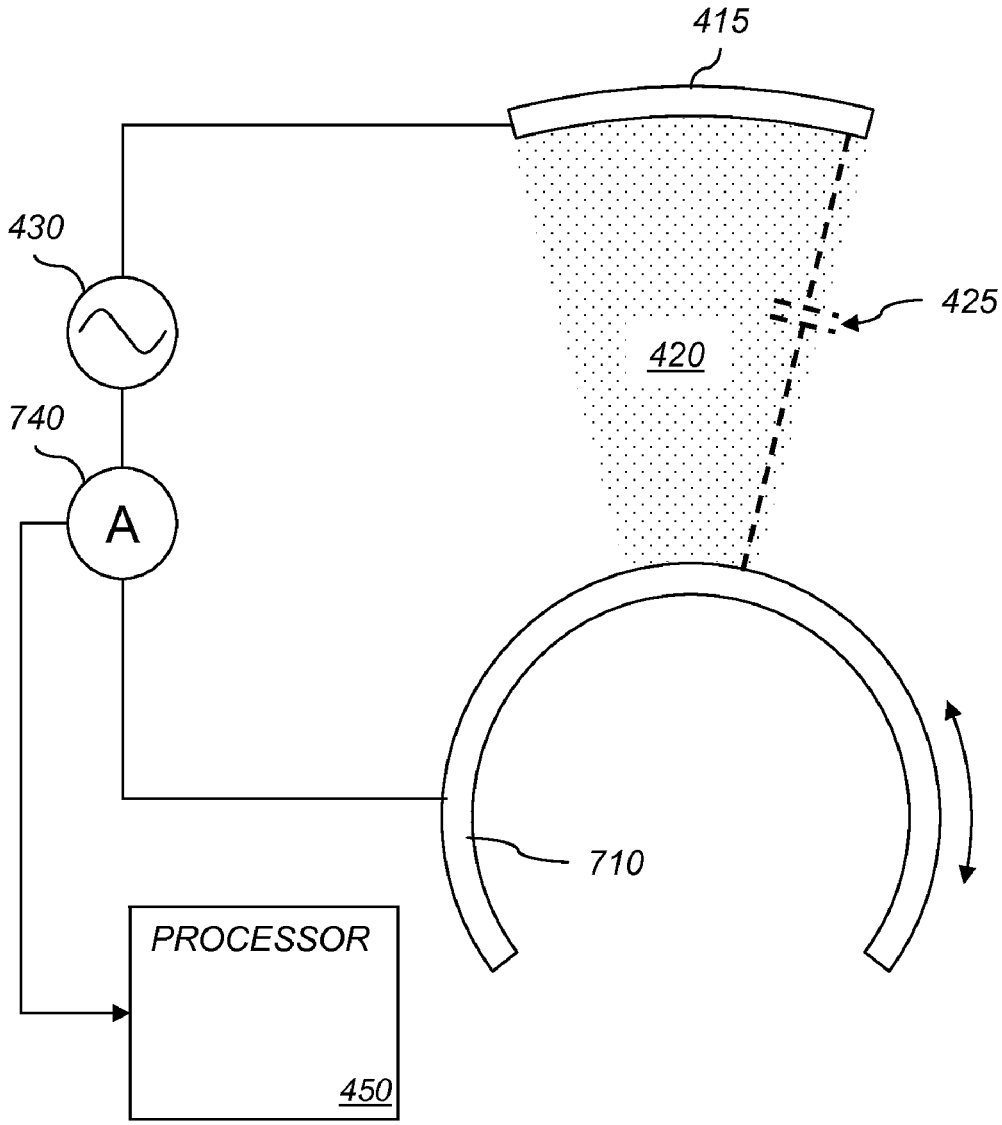
FIG. 7 shows an apparatus for measuring developer density in an electrophotographic system according to another embodiment of the present invention.

First electrode 410 and second electrode 415 are disposed to define working volume 420 between them. The shape shown for working volume 420 is merely illustrative; the actual shape of the working volume is defined by the electric field pattern between electrodes 410 and 415, or between electrode 415 and development member 710 (FIG. 7). Developer can move through working volume 420 without contacting first electrode 410. First electrode 410 and second electrode 415 are electrically insulated from each other by the working volume 420. In an embodiment, the working volume 420 is filled with air. The working volume 420 can also be filled with nitrogen or vacuum.

First electrode 410 and second electrode 415 are two terminals of a capacitor having capacitance 425; working volume 420 and anything in working volume 420 serve as the dielectric of the capacitor. This will be discussed further below with respect to FIG. 5. In an embodiment, first electrode 410 is grounded.

Voltage source 430 selectively applies an AC bias across first electrode 410 and second electrode 415. Voltage source 430 can be a commutated generator, sine-wave generator, arbitrary-waveform generator, programmable power supply, or other voltage sources known in the art capable of generating AC power. The AC bias is preferably sinusoidal. The magnitude and frequency of the AC bias are selected so that current can pass through the capacitor formed by first electrode 410, working volume 420, and second electrode 415. These magnitudes and frequencies can be selected by those skilled in the art. In various embodiments, first electrode 410 and second electrode 415 are arranged parallel to each other, are spaced apart 0.1", or are spaced apart by the expected maximum height of a developer blanket on one of the electrodes plus 0.03". In various embodiments, the AC bias is 3 $kV_{pk\text{-}pk}$ at 3 kHz. In various embodiments, first electrode 410 or second electrode 415 has a surface area facing the other electrode of 4 $in^2$. In various embodiments, the AC bias has a magnitude between 2.5 kV and 3.5 kV peak-to-peak, or a frequency between 2.5 kHz and 3.5 kHz.

Measuring device 440 measures the current across the electrodes while the AC bias is applied. Measuring device 440 can be a high-side or low-side current sensor, a Hall-effect sensor, a loop current meter (such as the FLUKE 902 TRUE-RMS HVAC CLAMP METER, which has a range of 0-600 A AC), or another current measurement unit known in the art. Measuring device 440 can measure the voltage drop across a known impedance and convert that measurement into current. Measuring device 440 can be connected in series with voltage source 430, as shown here, or in parallel with it. Measuring device 440 can include an analog-to-digital converter, an analog or digital low-pass filter, an instrumentation amplifier, a sample-and-hold unit, or other conditioning and conversion circuitry known in the art.

In another embodiment, voltage source 430 includes a switcher or other DC-to-AC power source, optionally followed by a step-up transformer. Measuring device 440 measures the DC input current to voltage source 430. Any of the current-sensing techniques discussed above can be used to measure this input current. For example, the voltage drop across a resistor in series with the DC input to voltage source 430 can be measured.

Processor 450 automatically determines the density of developer in working volume 420 based on the measured current and the applied bias. Processor 450 can be a CPU, GPU, FPGA, PAL, PLD, or other processor known in the art. Processor 450 can include a look-up table (LUT) preloaded with characterization data relating current and bias to density. Alternatively, the sensed current can be used as the feedback signal in a control system to adjust density by maintaining the sensed current within a target range. The target range can be determined by one skilled in the art, or can be automatically calculated by processor 450 using a calibration routine to measure the currents corresponding to a selected set of development hardware conditions. Instead of a LUT, a linear, polynomial, exponential, logarithmic, or other function, or piecewise combination of functions, can be used to relate current and bias to density. Throughout this disclosure, any LUT can be implemented in this way.

In various embodiments, the capacitance of the working volume is automatically determined. In steady-state AC, $V=ZI$ by Ohm's Law, so $Z=V/I$. The applied V is known, and I is measured, so Z is readily calculated. Capacitor 500 has complex impedance $Z=-j/\omega C$, so $C=-j/\omega Z$. The frequency $\omega$ of the applied bias is known, so C is readily calculated. The equivalent computation can be performed for an applied alternating current I and a measured voltage V to determine C.

Figure 5:
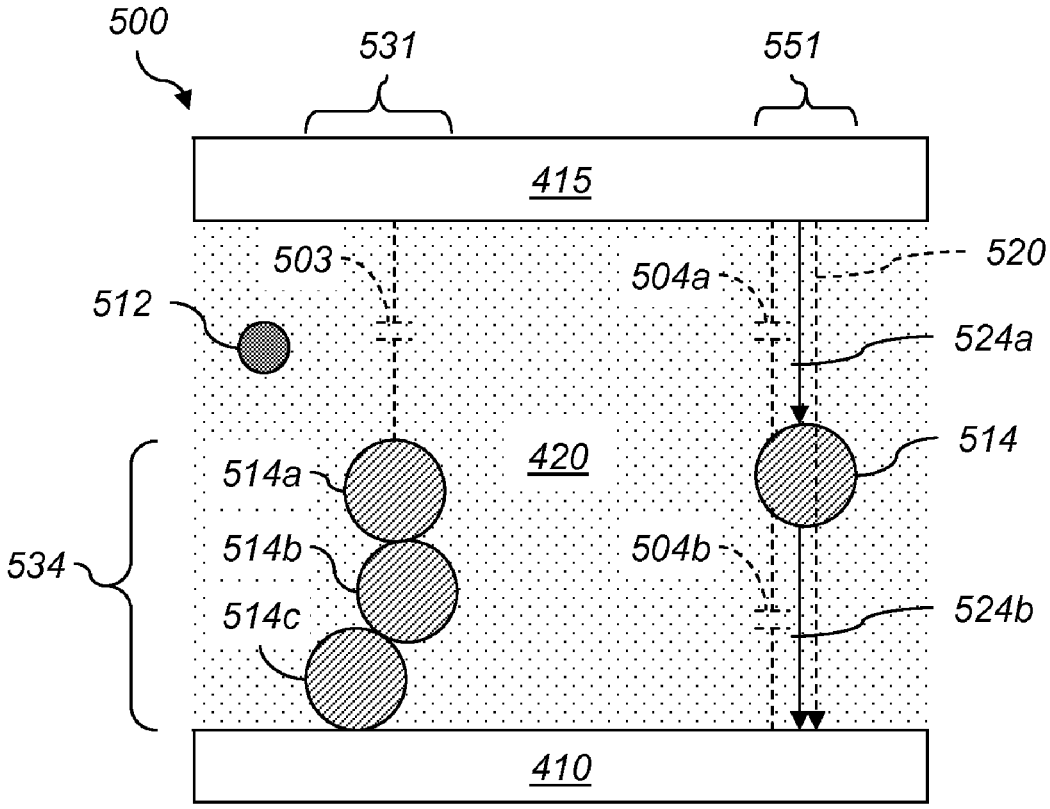
FIG. 5 shows details of the apparatus of FIG. 4 according to an embodiment of the present invention.

FIG. 5 shows details of the apparatus of FIG. 4 according to an embodiment of the present invention. As discussed above, first electrode 410 and second electrode 415 are two terminals of capacitor 500; working volume 420 and anything in working volume 420 serve as the dielectric of capacitor 500. When working volume 420 is empty of solids, the capacitor is a simple parallel-plate capacitor having the dielectric constant (relative permittivity) of the material in working volume 420 (vacuum=1, pure nitrogen gas at 20° C.=1.0005480, typical air=1.0006). Therefore the capacitance $C=\epsilon_r\epsilon_0 A/d$, for dielectric constant $\epsilon_r$, permittivity of free space $\epsilon_0=8.85\times 10^{-12}\ Fm^{-1}$, common area between the plates A, and distance d between the plates. This is true when there are no free charges between the plates of the capacitor (first electrode 410 and second electrode 415).

When no free charges are present, and developer is present in working volume 420, the capacitance between the plates increases. The dielectric constant increases when insulating materials such as toner particles or non-conductive carrier particles are added to the working volume, and the geometry of the capacitor changes by splitting capacitors and reducing spacings when electrically-conductive carrier particles are added to the working volume.

When electrically-insulating materials are added to working volume 420, the average dielectric constant of working volume 420 increases. For example, insulating toner particle 512 can have a dielectric constant on its own of 1.7, as discussed in commonly-assigned U.S. Pat. No. 5,655,183 to Tombs, the disclosure of which is incorporated herein by reference. In other embodiments, insulating toner particle 512 has a dielectric constant of 3±0.5, or 3±1. This increase in dielectric constant increases the capacitance of capacitor 500. Another example of an electrically-insulating material is a permanently-magnetized strontium ferrite carrier particle, which is not highly electrically conductive. In various embodiments, carrier particles are coated with polymers or other materials that are triboelectrically complementary to the toner, that is, materials that will charge when rubbed against toner particles. The material can be selected or doped by one skilled in the art to obtain a desired charge polarity and magnitude on the carrier and toner particles. Coated carrier particles can be electrically insulating even if they have an electrically-conductive core, since the outer surface of the particle is coated with an insulator.

When electrically-conductive materials are added to working volume 420, the geometry of capacitor 500 changes. For example, carrier particle 514, made of, e.g., manganese oxide, ferric oxide and titanium dioxide, is a conductor. Such a carrier particle is described in U.S. Pat. No. 6,294,304 to Sukovich et al., the disclosure of which is incorporated herein by reference. As a result, when carrier particle 514 is inserted in working volume 420, electric field line 520 in area 551 is changed to electric field lines 524*a*, 524*b*. Electric field lines 524*a*, 524*b* are shown offset horizontally from electric field line 520 for clarity only. As a result, capacitor 504*a* is formed between first electrode 410 and carrier particle 514, and capacitor 504*b* is formed between carrier particle 514 and second electrode 415. Each capacitor 504*a*, 504*b* has slightly more than twice the capacitance of the original capacitance between first electrode 410 and second electrode 415 in area 551, since the distance d for each (the lengths of electric field lines 504*a*, 504*b* respectively) has been reduced to less than one-half its former value (here, one-half of the length of electric field line 520 minus one-half of the diameter of carrier particle 514). Capacitors 504*a*, 504*b* add in series to total capacitance $C_T=[1/C_{504a}+1/C_{504b}]^{-1}$, so $C_T>C_{520}$. The more conductive particles are present, the more significant this effect is. Furthermore, conductive particles form additional capacitances between themselves.

Furthermore, as electrically-conductive material in contact with either first electrode 410 or second electrode 415, but not both, extends over more of the distance between first electrode 410 and second electrode 415, the capacitance between the free end of the conductive material and the non-contacted electrode increases. For example, chain 534 includes electrically-conductive carrier particles 514*a*, 514*b*, and 514*c*, which are in electrical contact with each other. Carrier particle 514*c* is in electrical contact with first electrode 410. Capacitor 503 has distance d approximately half its value before chain 534 is formed, so the capacitance in area 531 has approximately doubled.

The result of these effects is that the capacitance of capacitor 500 increases as the density of developer in working volume 420 increases, as long as there are substantially no free charges in working volume 420. The increase in capacitance decreases impedance, increasing current flow. That is, there is a positive correlation between developer density and current flow. An example of this effect is shown in FIG. 6D, below.

When free charges are present in working volume 420, the capacitance C of capacitor 500 cannot be calculated using the parallel-plate formulas. C is a function of capacitor geometry and the distribution of charge in working volume 420. This will now be discussed, with respect to *The Feynman Lectures on Physics, The Definitive Edition Volume* 2 (*2nd Edition*) by Richard P. Feynman, Robert B. Leighton, and Matthew Sands, San Francisco: Pearson/Addison-Wesley, 2005, ISBN 0-8053-9047-2, the disclosure of which is incorporated herein by reference, and particularly with respect to chapters 4, 6, 13, 15, and 17 thereof.

The voltage across a capacitor is by definition the work done in moving a unit charge between the plates against the electric field E between them=Es. The effect of Eon the momentum p of a particle with charge q in the field is qE=dp/dt, which is proportional to the acceleration a on the charge when mass is constant (i.e., at velocities v<<c.). Charges between the plates of the capacitor can be arranged in a way that will increase or decrease E at any point between the plates. When E is decreased by adding charge to working volume 420, electrons are decelerated between the plates, decreasing the current between the plates. Moreover, when positive charge is present in working volume 420, it will deflect electrons, increasing the mean path length between the plates of the capacitor and decreasing current (and likewise for negative charge with positive ions as charge carriers). These effects can cause a negative correlation between developer density and capacitor current. An example of a negative correlation is shown in FIG. 6A.

Figure 6A:
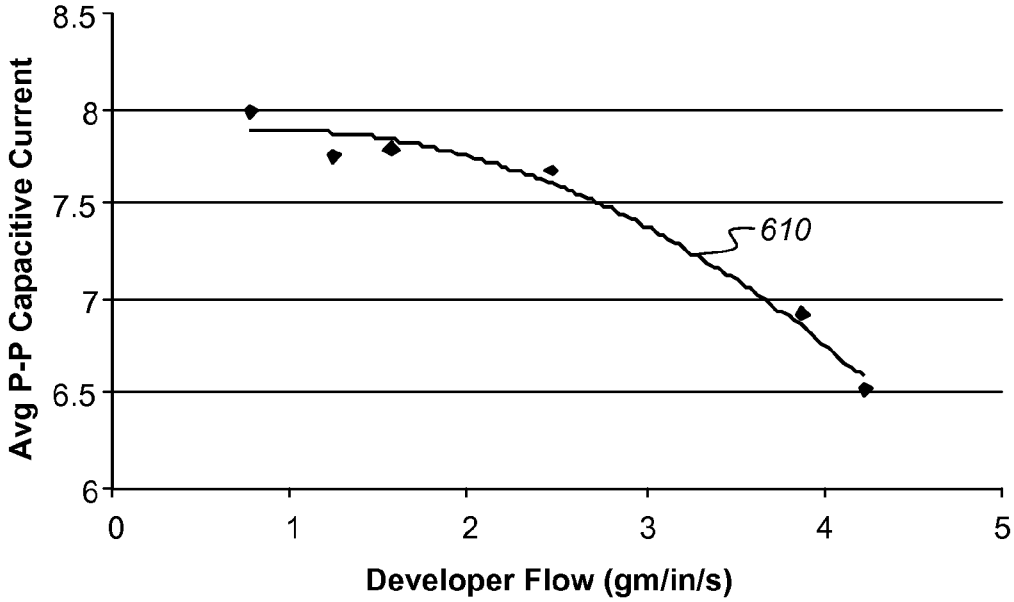
FIG. 6A shows experimental data relating developer flow rate to average peak-to-peak measured current.

FIG. 6A shows experimental data relating developer flow rate on the abscissa to average peak-to-peak measured current $I_{pk\text{-}pk,avg}$ through electrodes 410, 415 (FIG. 4) on the ordinate. The plotted points are measured data; curve 610 is a polynomial fit with equation $y=-0.1209x^2+0.2299x+7.7805$ and $R^2=0.9772$. Developer flow rate was used since developer density is difficult to directly control. In the configuration used in this experiment, developer density is negatively correlated with developer flow rate. A 3 $kV_{pk\text{-}pk}$ AC bias at 3 kHz was used, with A≈4 $in^2$ and s≈0.1". Curve 610 shows that as developer flow (thus developer density) rises, $I_{pk\text{-}pk,avg}$ falls.

Figure 6B:
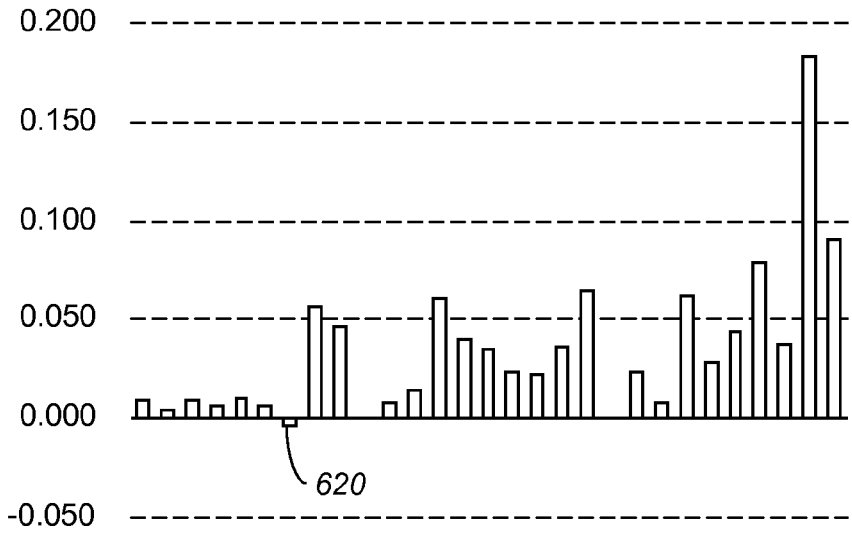
FIG. 6B shows a summary of experimental data relating developer flow rate to average peak-to-peak measured current under various conditions.
Figure 6D:
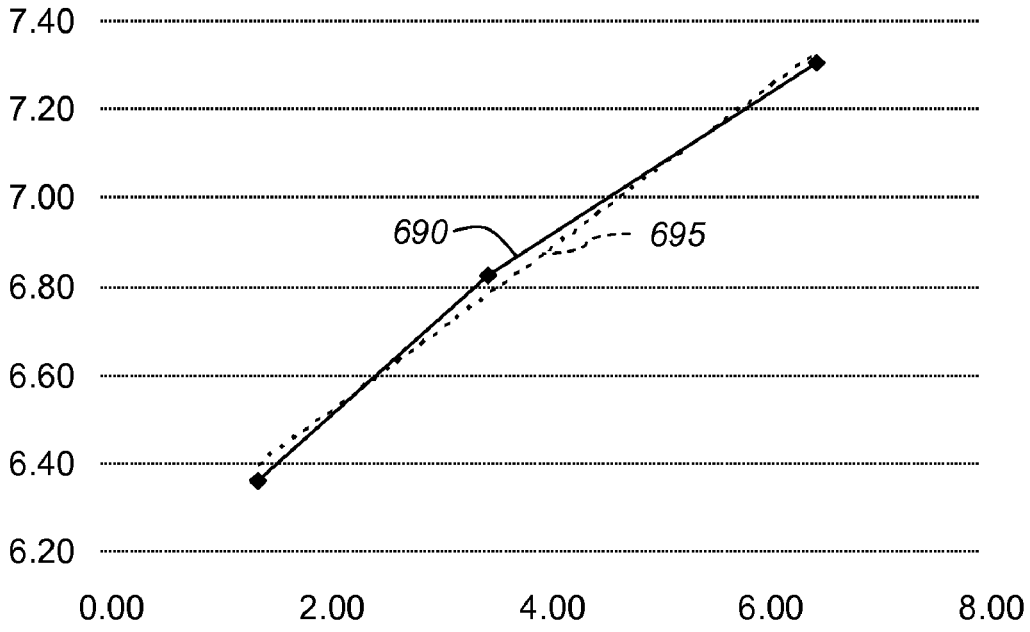
FIG. 6D shows experimental data relating developer flow rate to average peak-to-peak measured current.

FIG. 6B shows a summary of experimental data relating developer flow rate to average peak-to-peak measured current. Various experimental configurations were employed, covering variations in capacitor plate area (A), capacitor thickness (s), and frequency of the AC bias. In each configuration, data were collected relating average peak-to-peak measured current (dependent) to flow rate (independent). A linear fit of the collected data was performed for each configuration. The slopes of the linear fits are shown in FIG. 6B, with one bar per configuration. Most of the slopes were positive, indicating that current increased with flow rate as described above (positive correlation). However, configuration 620 has a negative slope (negative correlation), as do the data shown in FIG. 6A. Therefore, average peak-to-peak measured current can be positively or negatively correlated with developer flow rate.

FIG. 6C shows the conditions used in FIG. 6B. Measurements were taken using various plate areas, voltage amplitudes, frequencies, and electrode spacings. Measurements were taken as described above with respect to FIG. 6B. The slope, intercept, and $R^2$ of the linear fit for each condition are shown in the table. Each condition was measured at three different feed conditions (low/medium/high). The linear fits relate current (dependent) to flow rate (independent). In these tests, the three feed conditions were three voltages of the motor driving the feed roller to feed developer onto the development member. The speed of the development member was constant.

Negative slopes can be due to resonant effects due to parasitics in the measurement system. In practice, the circuit shown in FIG. 4 has parasitic resistances, inductances, and capacitances in addition to capacitance 425, shown. These parasitics can affect the behaviour of the circuit at the frequency of the AC bias, e.g., by adding poles or zeros.

In embodiments with significant parasitics, the DC input currents to voltage source 430 (FIG. 4) are preferably measured instead of the actual AC currents across working volume 420 (FIG. 4). When performing high-voltage, low-current measurements, parasitics can starve overload the power supply if care is not taken. Measuring the low-voltage, high-current input to voltage supply 430 reduces the chance of overload.

FIG. 6D shows an example of positive correlation. The axes are the same as FIG. 6A. As developer flow (abscissa, g/in/s) rises, current (ordinate, μA) rises as shown by curve 690. Fit 695 is a linear fit of current, with equation $y=0.1837x+6.132$, and $R^2=0.9918$. Linear, quadratic, or other fits can be made to measured data for ease of computation.

FIG. 7 shows apparatus for measuring developer density in an electrophotographic system according to an embodiment of the present invention. Rotatable development member 710 (e.g. toning shell 226) transports developer. Moreover, development member 710 performs the functions of first electrode 410 (FIG. 4). In an embodiment, development member 710 is grounded. Electrode 415 performs the functions of second electrode 415 shown in FIG. 4. Electrode 415 is displaced with respect to development member 710 to define working volume 420 between them. The shape shown for working volume 420 is merely illustrative; the actual shape of the working volume is defined by the electric field pattern between electrode 415 and development member 710. Developer can move through working volume 420, preferably without contacting the electrode. Electrode 415 is electrically insulated from development member 710 by working volume 420, so that capacitance 425 is formed between the electrode and the development member. Voltage source 430 is electrically connected to electrode 415 and development member 710 for selectively applying an AC bias, as described above, across working volume 420.

Measurement device 740 is electrically connected to electrode 415 and development member 710 for measuring the capacitance 425 of working volume 420 while development member 710 rotates. Measurement device 740 can include a meter (e.g. measuring device 440, shown in FIG. 4), an ammeter, a voltmeter, a capacitance meter based on resonant-frequency measurements, or another type of capacitance measurement device known in the art. Measurement device 740 can be connected in series with voltage source 430, as shown here, or in parallel with it.

Processor 450 automatically determines the density of the developer in the working volume based on the measured capacitance and the applied bias. Processor 450 can include a characterization LUT or function (as described above) mapping measured capacitance and bias to developer density.

Figure 8:
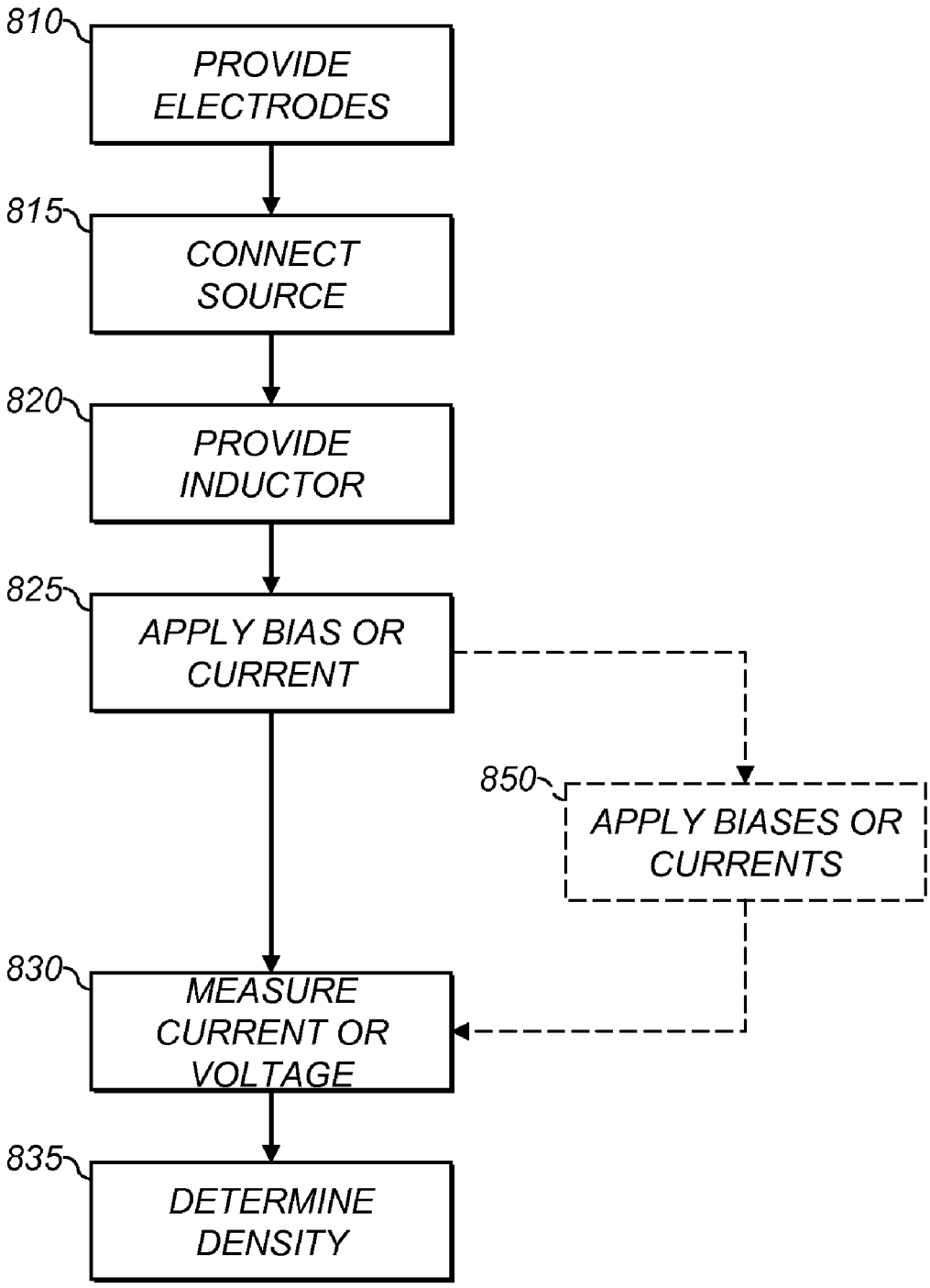
FIG. 8 shows a method of measuring developer density in an electrophotographic system according to an embodiment of the present invention.

FIG. 8 shows a method of measuring developer (i.e., toner, or toner and carrier, as described above) density in an electrophotographic system according to an embodiment of the present invention.

Processing begins with step 810. In step 810, a first electrode and a second electrode are provided, e.g., as shown in FIG. 4. The electrodes are disposed to define a working volume between them through which developer passes without contacting the first electrode, and the electrodes are electrically insulated from each other by the working volume. Step 810 is followed by step 815.

In step 815, one terminal of a power source is connected to one of the electrodes. The power source can be a voltage source or a current source. In embodiments providing a voltage source, the voltage source is adapted to selectively provide an AC bias having a selected magnitude and frequency to the connected electrode. In embodiments providing a current source, the current source is adapted to selectively provide an alternating current having a selected magnitude and frequency to the connected electrode. Step 815 is followed by step 820.

In step 820, an inductor is provided. In embodiments providing a voltage source, the inductor is provided electrically connected in series with the voltage source and is connected to the other of the electrodes, i.e., to the electrode to which the voltage source is not connected. In this way, the voltage source provides the AC bias across the electrodes through the inductor. The voltage source therefore provides the AC bias across a series-resonant tank circuit including the inductor and the capacitance between the electrodes.

In embodiments providing a current source, the inductor is provided electrically connected in parallel with the current source. The current source and inductor are both connected to both of the electrodes, so that the current source provides the alternating current across the electrodes. The current source therefore provides the alternating current into a parallel-resonant tank circuit including the inductor and the capacitance between the electrodes. Step 820 is followed by step 825.

In step 825, a bias is applied using the voltage source, or a current is applied using the voltage source. Step 825 is followed by step 830, or, optionally, step 850. In optional step 850, a plurality of biases or currents having different frequencies is applied. Step 850 is followed by step 830.

In step 830, the current is measured for an applied bias, or the voltage across the current source is measured for an applied current. In embodiments applying a plurality of biases or currents, respective currents or voltages are measured. Step 830 is followed by step 835.

In step 835, the density is automatically determined using a processor (e.g., processor 450, as described above). In embodiments using a single current, density is determined as described above and as shown in FIGS. 4 and 6. The processor is responsive to the measured current and the applied bias.

In embodiments using a single applied alternating current, the processor determines the capacitance of the working volume based on the relationship between applied current and measured voltage, as described above. The processor then automatically determines the density of the developer in the working volume based on the measured capacitance. Processor 450 can include a characterization LUT or function (as described above) mapping measured capacitance and current to developer density.

In embodiments using a plurality of applied biases or currents, the density of the developer can be automatically determined by determining a density for each measurement individually. The measurements are then combined, e.g., by arithmetic or geometric averaging or taking the RMS value (quadratic mean), to produce a single measured density.

In other embodiments using a plurality of applied biases or currents, the density is determined using the processor based on the plurality of biases and the measured respective currents. Specifically, the capacitance of the working volume is automatically determined from the resonant properties of the tank circuit, and the density is determined from the capacitance as described above. In steady-state AC, V=ZI by Ohm's Law, so Z=V/I.

Figure 9:
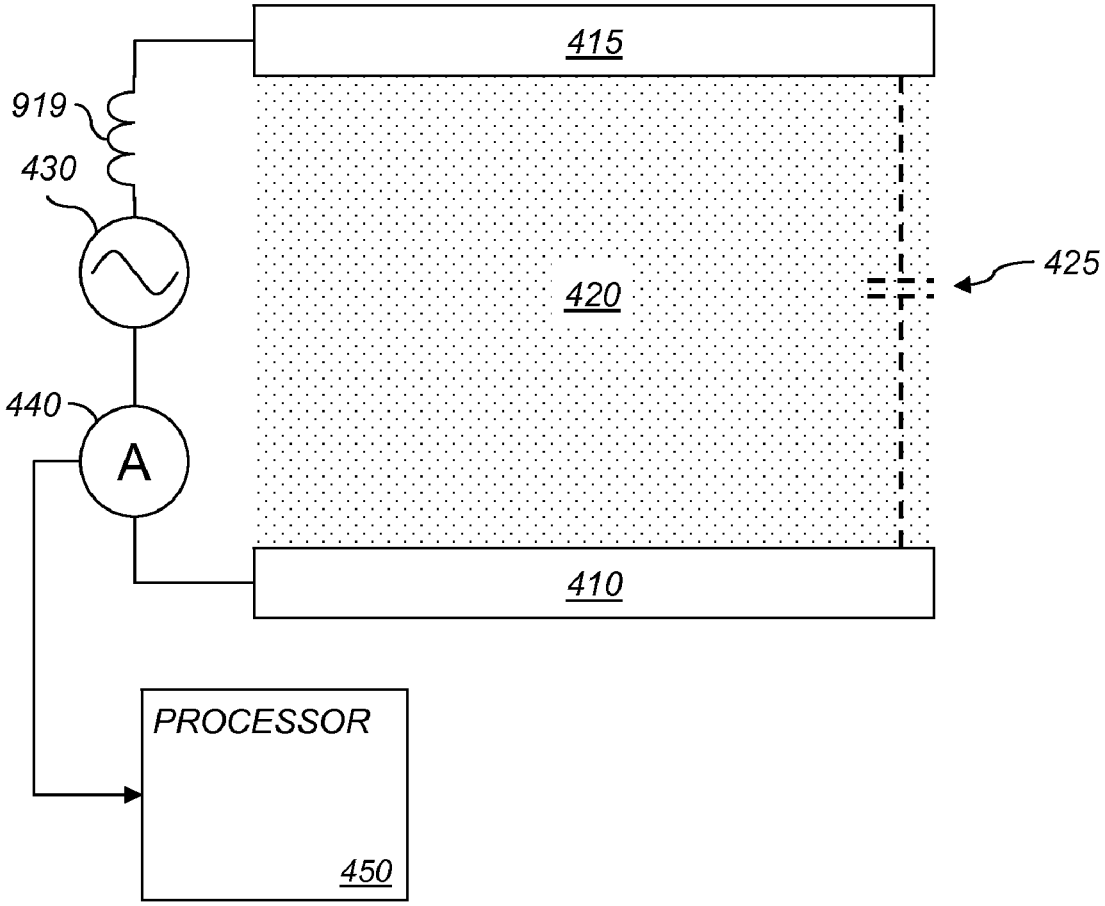
FIG. 9 shows apparatus using a series-resonant tank circuit and a voltage source according to an embodiment of the present invention.

FIG. 9 shows an apparatus using a series-resonant tank circuit and a voltage source. First electrode 410, second electrode 415, working volume 420, capacitance 425, voltage source 430, measuring device 440, and processor 450 are as shown in FIG. 4. Inductor 919 is connected in series with voltage source 430. V is known, I is measured, and Z is calculated. Each applied bias has a different frequency, and a different Z. At the resonant frequency of the tank, Z=0, neglecting non-idealities such as wire resistance. The resonant frequency $f_r$ is determined by selecting the lowest impedance (highest current for a given applied bias) from the measured current data or by interpolation between measured currents or between calculated impedance values. $f_r = [2\pi(LC)^{1/2}]^{-1}$, and L is known, so C is calculated from L and $f_r$:

$$C = \frac{L}{(2\pi f)^2} \quad \text{(Eq. 1)}$$

The calculated capacitance C is then used to determine density, as discussed above.

Figure 10:
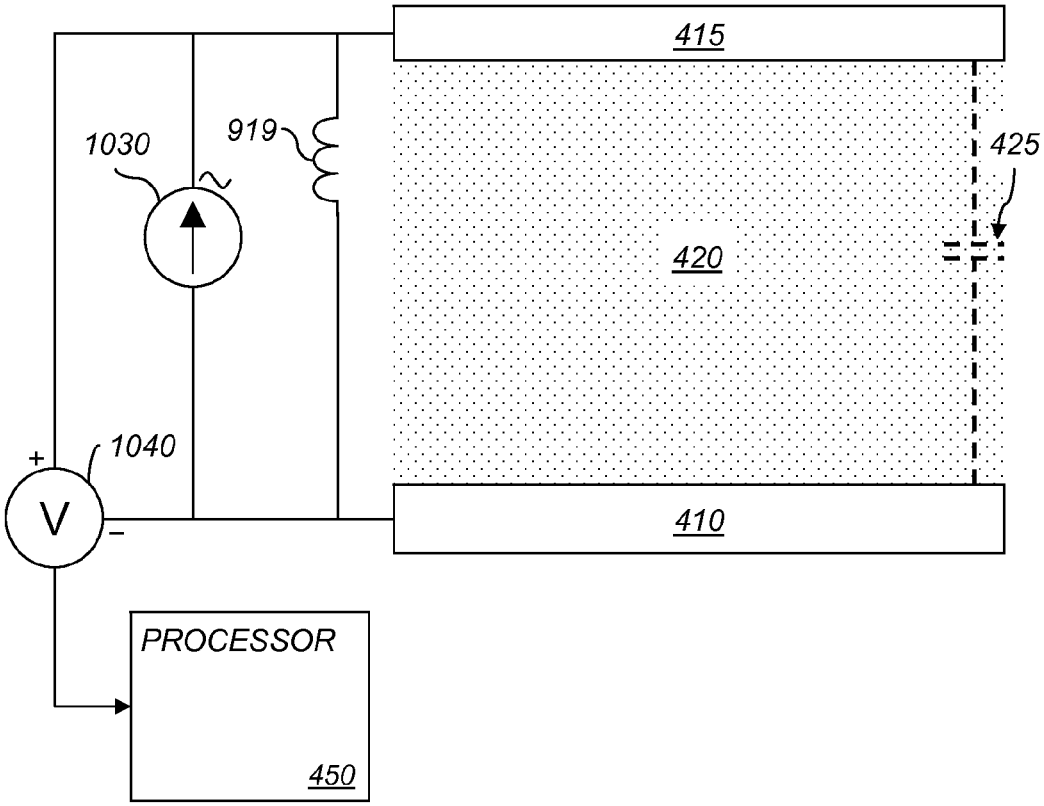
FIG. 10 shows an apparatus using a parallel-resonant tank circuit and a current source according to an embodiment of the present invention.

FIG. 10 shows an apparatus using a parallel-resonant tank circuit and a current source. First electrode 410, second electrode 415, working volume 420, capacitance 425, and processor 450 are as shown in FIG. 4. Current source 1030 provides a known alternating current I across capacitance 425 and inductor 919. Measuring device 1040 (e.g., a voltmeter) measures the voltage across current source 1030, inductor 919, and capacitance 425 (the three voltages are the same since they are connected in parallel). I is known, V is measured, and Z is calculated. Each applied bias has a different frequency, and a different Z. At the resonant frequency of the tank, Z=∞, neglecting non-idealities such as series resistance of the inductor. The resonant frequency $f_r$ is determined by selecting the highest impedance (highest voltage for a given applied current) from the measured current data or by interpolation between measured currents or between calculated impedance values. C is calculated from L and $f_r$ using Eq. 1, above. The calculated capacitance C is then used to determine density, as discussed above.

Developer density is related to toner concentration and developer flow rate. In various embodiments, these factors can be determined individually.

Figure 11:
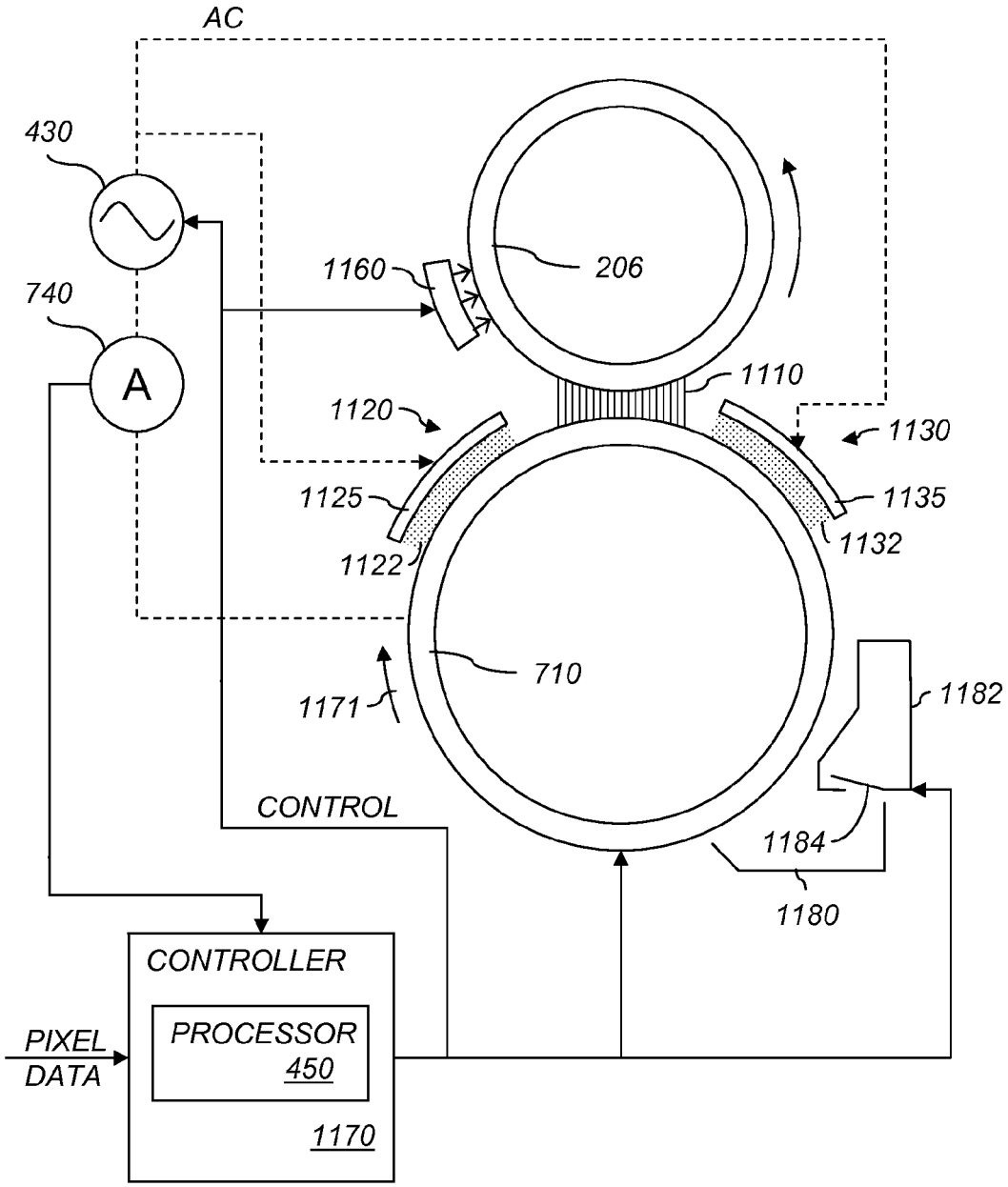
FIG. 11 shows an apparatus for measuring developer toner concentration useful with the present invention.

FIG. 11 shows an embodiment of an apparatus for measuring developer toner concentration in an electrophotographic system. Rotatable development member 710 is as shown in FIG. 7. A drum, belt, foam roller, or other type of development member known in the art can be used. Movable photoreceptor 206 is arranged so that toning zone 1110 is defined between development member 710 and photoreceptor 206, and development member 710 selectively supplies developer to photoreceptor 206 in toning zone 1110 while development member 710 or photoreceptor 206 rotates. In various embodiments, the developer includes toner particles and carrier particles.

Patterning unit 1160 is adapted to produce an electrostatic latent image on the photoreceptor. Patterning unit 1160 can include an exposure subsystem 220 as shown in FIG. 3, e.g., a laser or a bank of LEDs to expose photoreceptor 206 to actinic radiation.

Sensors 1120 and 1130 are disposed over the surface of development member 710, one before and one after toning zone 1110 in direction of rotation 1171 of development member 710. Each sensor includes a respective electrode 1125, 1135 arranged with respect to development member 710 to form a respective capacitance (as shown in FIG. 4) between the respective electrode 1125, 1135 and development member 710. The respective electrodes 1125, 1135 define respective working volumes 1122, 1132 between the respective electrodes 1125, 1135 and development member 710. Developer passes through the respective working volumes 1122, 1132 without contacting the respective electrodes 1125, 1135, and the respective electrodes 1125, 1135 are electrically insulated from development member 710 by the respective working volumes 1122, 1132.

Voltage source 430 is as shown in FIG. 4, and can include one supply or two independent supplies. Voltage source 430 selectively applies respective AC biases across the respective working volumes 1122, 1132 of the sensors 1120, 1130. The biases can be the same or different. Voltage source 430 can drive the electrodes 1125, 1135, or it can drive the development member. Lines carrying the AC bias are shown dashed in this figure for clarity; lines carrying control signals are shown solid.

Measuring device 740 is as shown in FIG. 7. It is connected in series with voltage source 430 for measuring respective currents across the respective working volumes 1122, 1132 while the respective biases are applied.

In an alternative embodiment, a series- or parallel-resonant configuration, as shown in FIGS. 9-10, is used for each sensor. In a parallel-resonant configuration, a current source is used in place of voltage source 430, and a voltmeter is used in lace of measuring device 740.

Controller 1170 controls the operation of the apparatus, and can include or communicate with a processor 450, described above. Processor 1170 can be a CPU, GPU, FPGA, PAL, PLD, or other processor known in the art.

Controller 1170 receives pixel data corresponding to toner to be applied to the photoreceptor. Controller 1170 then causes patterning unit 1160 to produce an electrostatic latent image corresponding to the received pixel data on photoreceptor 206. In an embodiment, the pixel data is a pre-selected test or calibration pattern.

After the electrostatic latent image is patterned, controller 1170 causes development member 710 to rotate and photoreceptor 206 to move. This can be accomplished using motors and drives known in the art, such as servomotors with optical quadrature encoders for closed-loop control.

While development member 710 is rotating, developer is moving through toning zone 1110. Toner in the developer is being attracted to the latent image on photoreceptor 206. Therefore, the toner concentration of developer in working volume 1132 is less than the toner concentration of developer in working volume 1122. Controller 1170 receives respective currents measured by measuring device 740 for each sensor 1120, 1130. Two meters and two sources can be used, one per sensor, or the bias can be provided to, and current measured from, one sensor (1120 or 1130) at a time.

Controller 1170 (or processor 450, as described above) then computes toner concentration using the respective received currents and the pixel data. The respective density of developer in each working volume 1122, 1132 is determined as described above. If no carrier particles have been lost by pick-up onto photoconductor 206, and if the magnetic field strength in working volume 1132 is the same as that in working volume 1122, sensors 1120, 1130 will report results that differ only as a result of the removal of toner from the developer and its deposition on photoreceptor 206. Specifically, developer flow rate is the same in working volumes 1122 and 1132. Adjustments for lost carrier particles and varying magnetic field strengths can be made by those skilled in the electrophotographic art. Lost carrier particles reduce density, so the measured density in working volume 1132 can be increased to compensate. A difference of magnetic field strength can be used to compute the difference in nap height, or the respective nap heights in working volumes 1122, 1132 can be measured. The measured densities can then be normalized using the differences in nap height.

Controller 1170 computes the expected amount of toner removed in toning zone 1110 using the received pixel data. For example, the controller can receive, e.g., from a characterization file, the mass laydown per unit area for a 100% laydown of developer, and the mass and volume of toner particles. The controller can therefore calculate the amount of mass and volume deposited on a 100% patch of a given area (which area is computed from the pixel data and the size of each pixel).

Toner concentration (TC) is the mass percentage of toner particles in a given mass of developer. If TC is low, removing a certain amount of toner will have a small effect on developer density, because not that much toner is present to begin with. If TC is high, removing that amount of toner will have a large effect on developer density. These effects can be characterized before shipping a printer, and controller 1170 can use a lookup table or function (as described above) of the characterization data to map the respective currents from sensors 1120 and 1130, and the received pixel data, to toner concentration.

In various embodiments, controller 1170 maintains toner concentration at a desired level. Sump 1180 (represented graphically here) holds developer to be applied to development member 710 for transfer to photoreceptor 206. Toner bottle 1182 holds additional toner to be added to carrier particles in sump 1180 to provide replenished toner. Toner bottle 1182 includes gate 1184 operated by controller 1170. This is discussed further with reference to FIG. 12.

Figure 12:
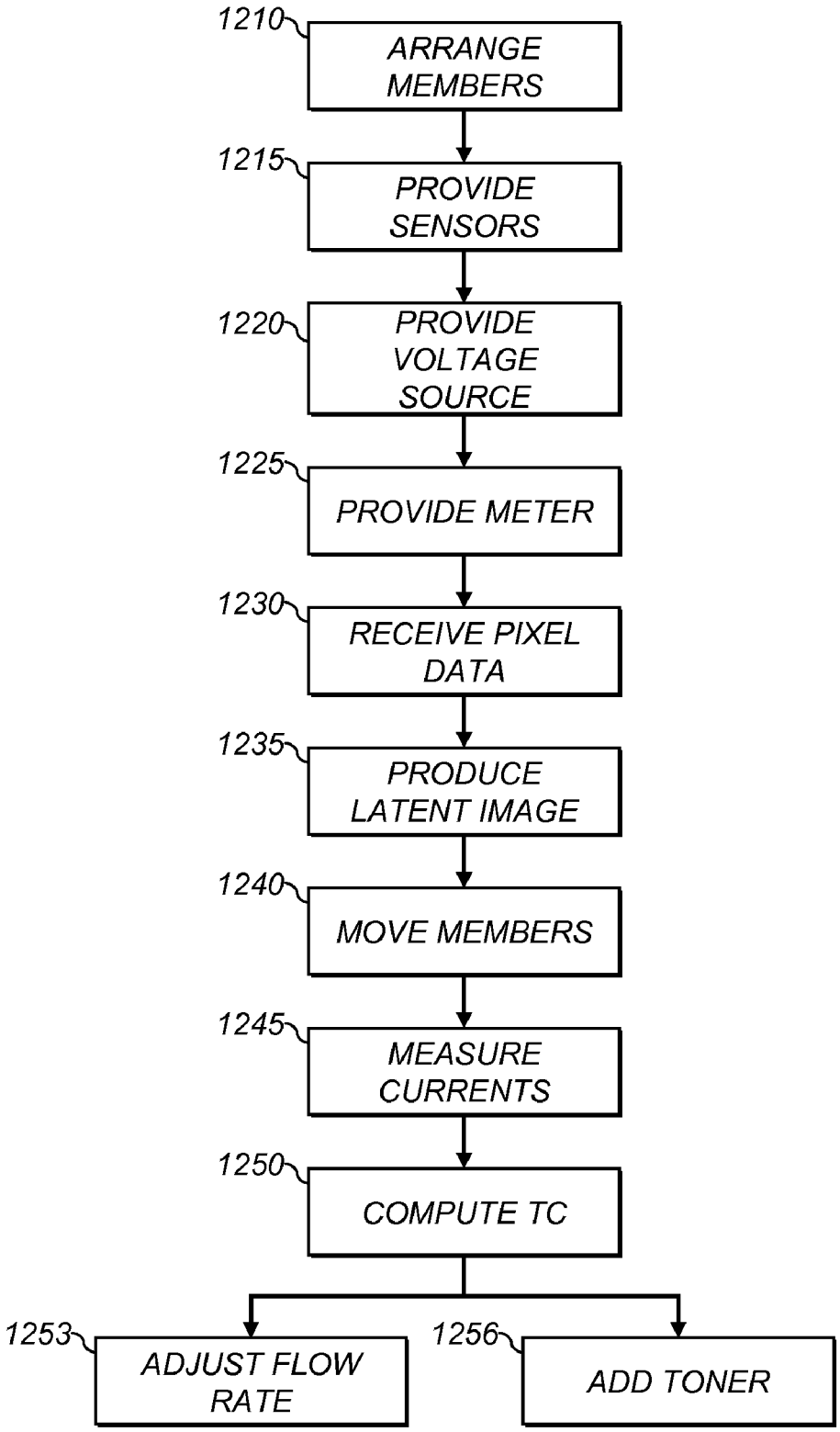
FIG. 12 shows a method of controlling toner concentration useful with the present invention.

FIG. 12 shows a method of controlling developer toner concentration in an electrophotographic system. Processing begins with step 1210. An example of apparatus useful in the practice of various embodiments of this method is shown in FIG. 11, from which part numbers are given in parentheses to aid the understanding of this method. Other apparatus can also be used in the practice of this method.

Referring to FIG. 12 and also to FIG. 11, in step 1210, a rotatable development member (710) and a movable photoreceptor (206) are arranged so that a toning zone (1110) is defined between them. In this way the development member selectively supplies developer to the photoreceptor in the toning zone while it rotates. In this embodiment, the developer includes toner and carrier particles. Step 1210 is followed by step 1215.

In step 1215, two sensors (1120, 1130) are provided. One sensor (1120) is disposed before the toning zone in the direction of rotation of the development member, and one after (1130). Each sensor includes a respective electrode (1125, 1135) arranged with respect to the development member to form a respective capacitance between the respective electrode and development member. Each respective electrode defines a respective working volume (1122, 1132) between the respective electrode and the development member, wherein developer passes through the respective working volume without contacting the electrode, and the respective electrode is electrically insulated from the development member by the respective working volume. Step 1215 is followed by step 1220.

In step 1220, a voltage source (430) is provided. The voltage source selectively applies respective AC biases across the respective working volumes of the sensors. The biases can be the same or different, and can differ in phase, amplitude, or frequency content (e.g., number of superimposed waveforms). The voltage source can drive the electrode in each sensor or the development member. The voltage source can include one supply or two independent supplies for its two terminals. Step 1220 is followed by step 1225.

In step 1225, a measuring device (740) is provided. The measuring device measures respective currents across the respective working volumes while the respective biases are applied Step 1225 is followed by step 1230.

In step 1230, pixel data are received (by controller 1170) that correspond to toner to be applied to the photoreceptor. Step 1230 is followed by step 1235.

In step 1235, a patterning unit (1160) is caused to produce an electrostatic latent image corresponding to the received pixel data on the photoreceptor. Step 1235 is followed by step 1240.

In step 1240, the members are moved. Specifically, after the electrostatic latent image is patterned, the development member is caused to rotate and the photoreceptor to move. Step 1240 is followed by step 1245.

In step 1245, while the development member is rotating, the measuring device measures respective currents across the respective working volumes due to the respective applied AC biases. Step 1245 is followed by step 1250.

In step 1250, the toner concentration is automatically computed using a processor (450). The processor, which can be an FPGA, CPU, PLD, or other logic device, is responsive to the respective received currents and the pixel data.

Step 1250 is followed by step 1253 or step 1256. Steps 1253 and 1256 adjust printer operational parameters in response to the determined toner concentration. In step 1253, the developer flow rate is adjusted, e.g., by adjusting the speed of rotation of the development member, the metering skive gap, the feed roller speed, or the toning roller magnetic field strength. In step 1256, toner is added to the developer, e.g., by opening the gate (1184) on the toner bottle (1182). These adjustments maintain laydown in a desired range. Toner concentration changes gradually, and the adjustments listed above take effect quickly. Therefore, toner concentration can be accurately maintained. Moreover, flow control provides a fine adjustment useful within a print or a small number of prints, while adding toner provides a coarser adjustment useful over large numbers of prints. Flow control can be adjusted between prints.

Figure 13:
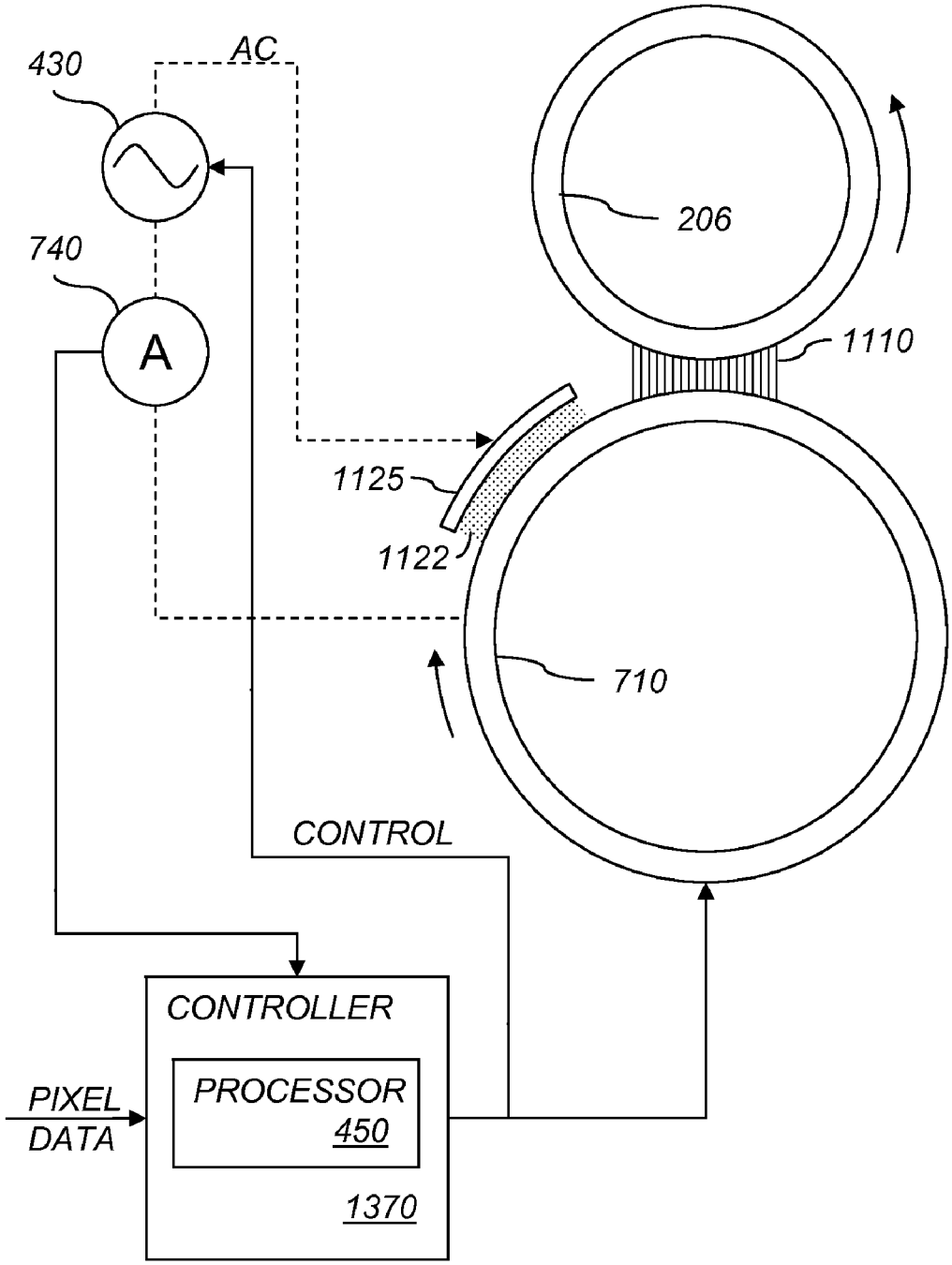
FIG. 13 shows an apparatus for measuring developer flow rate useful with the present invention.

FIG. 13 shows an apparatus for measuring developer flow rate in an electrophotographic system. Rotatable development member 710, electrode 1125, working volume 1122, voltage source 430, and measuring device 740 are as shown in FIG. 11. Electrode 1125 can be located before or after toning zone 1110 in the direction of rotation of development member 710.

In an alternative embodiment, a series- or parallel-resonant configuration, as shown in FIGS. 9-10, is used for each sensor. In a parallel-resonant configuration, a current source is used in place of voltage source 430, and a voltmeter is used in place of measuring device 740.

Controller 1370 controls the operation of the apparatus, and can include or communicate with a processor 450, described above. Processor 1370 can be a CPU, GPU, FPGA, PAL, PLD, or other processor known in the art.

Processor 1370 causes development member 710 to stop supplying toner to the photoreceptor. By "stop supplying" it is meant that the intentional flow of toner stops. Some toner can move to the photoreceptor because of residual charges and electric fields. Processor 1370 then causes development member 710 to rotate. While development member 710 is rotating, controller 1370 records the current measured by measuring device 740. Controller 1370 then automatically computes developer flow rate using the measured current from measuring device 740. A characterization LUT or function, as described above, can be used to convert the measured current into flow rate.

Figure 14:
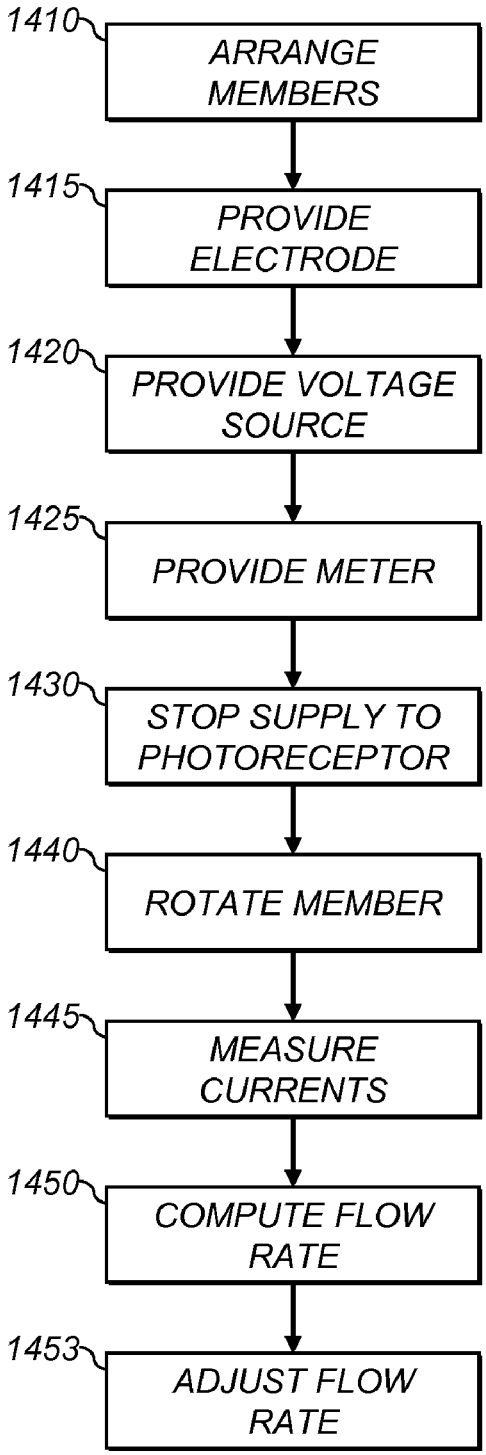
FIG. 14 shows a method of controlling flow rate useful with the present invention.

FIG. 14 shows a method of controlling developer flow rate in an electrophotographic system. Processing begins with step 1410. An example of apparatus useful in the practice of various embodiments of this method is shown in FIG. 13, from which part numbers are given in parentheses to aid the understanding of this method. Other apparatus can also be used in the practice of this method.

Referring to FIG. 14 and also to FIG. 13, in step 1410, a rotatable development member (710) and a movable photoreceptor (206) are arranged so that a toning zone (1110) is defined between them, and the development member selectively supplies developer to the photoreceptor in the toning zone while it rotates. The developer includes toner and carrier particles. Step 1410 is followed by step 1415.

In step 1415, an electrode (1125) is provided. The electrode is arranged with respect to the development member to form a capacitance between the electrode and development member, and to define a working volume (1122) between the electrode and the development member. Developer passes through the working volume without contacting the electrode, and the electrode is electrically insulated from the development member by the working volume. Step 1415 is followed by step 1420.

In step 1420, a voltage source for selectively applying an AC bias across the working volume is provided. Step 1420 is followed by step 1425.

In step 1425, a measuring device for measuring a current across the working volume while the bias is applied is provided. Step 1425 is followed by step 1430.

In step 1430, the supply of developer to the photoreceptor is stopped. Specifically, the development member is caused to stop supplying toner to the photoreceptor. This is accomplished by adjusting the voltages on the development member and photoreceptor, by interposing a mechanical gate in part or all of the toning zone, or by moving the development member and photoreceptor away from each other. Step 1430 is followed by step 1440.

In step 1440, the development member is rotated, e.g., by driving it with a servomotor or stepper motor. Developer therefore moves with the development member at a certain developer flow rate. Step 1440 is followed by step 1445.

In step 1445, while the development member is rotating, the AC bias is applied using the voltage source and the current is measured using the measuring device. Step 1445 is followed by step 1450.

In step 1450, the developer flow rate is automatically computed using a processor (450) responsive to the measured current. Step 1450 is followed by step 1453.

In step 1453, the flow rate is adjusted, e.g., by changing the speed of rotation of the development member, the metering skive gap, the feed roller speed, or the toning roller magnetic field strength. These adjustments can maintain the flow at a desired rate. These adjustments are described above with reference to FIG. 13.

In various embodiments of sensors and measurement devices described above, other configurations of tank circuits are used, including using current or voltage sources with series or parallel tank circuits, as will be obvious to those skilled in the art. In all circuit configurations discussed herein, negative and positive terminals can be interchanged as will be obvious to those skilled in the art.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
102, 103 roller
104 transmission densitometer
105 power supply
109 interframe area
110 light beam
111, 121, 131, 141, 151 imaging member
112, 122, 132, 142, 152 transfer member
113, 123, 133, 143, 153 transfer backup member
124, 125 corona tack-down chargers
201 transfer nip
202 second transfer nip
206 photoreceptor
210 charging subsystem
211 measuring device
212 measuring device
213 grid
216 surface
220 exposure subsystem
225 development station
226 toning shell
227 magnetic core
240 power source
410 first electrode
415 second electrode
420 working volume
425 capacitance
430 voltage source
440 measuring device
450 processor
500 capacitor
503, 504*a*, 504*b* capacitor
512 toner particle
514, 514*a*, 514*b*, 514*c* carrier particle
520, 524*a*, 524*b* electric field line
531 area
534 chain
551 area
610 curve
620 configuration
690 curve
695 fit
710 development member
740 measurement device
810 provide electrodes step
815 connect source step
820 provide inductor step
825 apply bias or current step
830 measure current or voltage step
835 determine density step
850 apply biases or currents step
919 inductor
1030 current source
1040 voltmeter
1110 toning zone
1120, 1130 sensor
1122, 1132 working volume
1125, 1135 electrode
1160 patterning unit
1170 controller
1171 direction of rotation
1180 sump
1182 toner bottle
1184 gate
1210 arrange members step
1215 provide sensors step
1220 provide voltage source step
1225 provide measuring device step
1230 receive pixel data step
1235 produce latent image step
1240 move members step
1245 measure currents step
1250 compute tc step

1253 adjust flow rate step
1256 add toner step
1370 controller
1410 arrange members step
1415 provide electrode step
1420 provide voltage source step
1425 provide measuring device step
1430 stop supply to photoreceptor step
1440 rotate member step
1445 measure currents step
1450 compute flow rate step
1453 adjust flow rate step
$R_n$–$R_{(n-6)}$ receiver
PC1-PC5 imaging member
ITM1-ITM5 transfer member
TR1-TR5 transfer back up member
S slow scan direction

The invention claimed is:

1. A method of measuring developer density in an electrophotographic system, comprising:

providing a first electrode and a second electrode disposed to define a working volume between them through which developer passes without contacting the first electrode, wherein the electrodes are electrically insulated from each other by the working volume;

connecting one terminal of a voltage source for selectively providing an AC bias having a selected frequency to one of the electrodes;

providing an inductor in series with the voltage source, the inductor being connected to the other of the electrodes, whereby the source provides the AC bias across the electrodes through the inductor;

applying the bias using the voltage source;

measuring the current across the electrodes while the bias is applied;

repeating the applying and measuring steps so that multiple biases having different frequencies are applied and respective currents are measured; and automatically determining the density of the developer in the working volume using a processor based on the multiple biases and the measured respective currents.

2. The method according to claim 1, wherein the developer includes toner particles and magnetic carrier particles.

3. The method according to claim 1, wherein the first electrode is grounded.

4. A method of measuring developer density in an electrophotographic system, comprising:

providing a first electrode and a second electrode disposed to define a working volume between them through which developer passes without contacting the first electrode, wherein the electrodes are electrically insulated from each other by the working volume;

connecting the two terminals of a current source for selectively providing an alternating current having a selected frequency to the first and second electrodes, respectively;

providing an inductor in parallel with the current source, whereby the source provides the alternating current across the electrodes and the inductor;

applying the alternating current using the current source;

measuring the voltage across the electrodes while the current is applied;

repeating the applying and measuring steps so that multiple alternating currents having different frequencies are applied and respective voltages are measured; and automatically determining the density of the developer in the working volume using a processor based on the multiple currents and the measured respective voltages.

5. The method according to claim 4, wherein the developer includes toner particles and magnetic carrier particles.

6. The method according to claim 4, wherein the first electrode is grounded.

7. A method of measuring developer density in an electrophotographic system, comprising:

providing a first electrode and a second electrode disposed to define a working volume between them through which developer passes without contacting the first electrode, wherein the electrodes are electrically insulated from each other by the working volume;

connecting one terminal of a voltage source for selectively providing an AC bias having a selected frequency to one of the electrodes;

providing an inductor in series with the voltage source, the inductor being connected to the other of the electrodes, whereby the source provides the AC bias across the electrodes through the inductor and the AC bias has a magnitude between 2.5 kV and 3.5 kV peak-to-peak;

applying the bias using the voltage source;

measuring the current across the electrodes while the bias is applied; and automatically determining the density of the developer in the working volume using a processor responsive to the measured current and the applied bias.

8. The method according to claim 7, wherein the developer includes toner particles and magnetic carrier particles.

9. The method according to claim 7, wherein the first electrode is grounded.

10. A method of measuring developer density in an electrophotographic system, comprising:

providing a first electrode and a second electrode disposed to define a working volume between them through which developer passes without contacting the first electrode, wherein the electrodes are electrically insulated from each other by the working volume;

connecting one terminal of a voltage source for selectively providing an AC bias having a selected frequency to one of the electrodes;

providing an inductor in series with the voltage source, the inductor being connected to the other of the electrodes, whereby the source provides the AC bias across the electrodes through the inductor and the AC bias has a frequency between 2.5 kHz and 3.5 kHz;

applying the bias using the voltage source;

measuring the current across the electrodes while the bias is applied; and automatically determining the density of the developer in the working volume using a processor responsive to the measured current and the applied bias.

11. The method according to claim 10, wherein the developer includes toner particles and magnetic carrier particles.

12. The method according to claim 10, wherein the first electrode is grounded.

13. A method of measuring developer density in an electrophotographic system, comprising:

providing a first electrode and a second electrode disposed to define a working volume between them through which developer passes without contacting the first electrode, wherein the electrodes are electrically insulated from each other by the working volume;

connecting the two terminals of a current source for selectively providing an alternating current having a selected frequency to the first and second electrodes, respectively;

providing an inductor in parallel with the current source, whereby the source provides the alternating current across the electrodes and the inductor and the alternating current has a frequency between 2.5 kHz and 3.5 kHz;

applying the alternating current using the current source;

measuring the voltage across the electrodes while the current is applied; and automatically determining the density of the developer in the working volume using a processor responsive to the measured voltage and the applied bias.

14. The method according to claim 13, wherein the developer includes toner particles and magnetic carrier particles.

15. The method according to claim 13, wherein the first electrode is grounded.

* * * * *